US006546654B1

(12) United States Patent
Henson

(10) Patent No.: US 6,546,654 B1
(45) Date of Patent: Apr. 15, 2003

(54) DISPLAY STAND

(75) Inventor: David L. Henson, Northfield, MN (US)

(73) Assignee: Color Garden, Inc., Dundas, MN (US)

( * ) Notice: Subject to any disclaimer, the term of this patent is extended or adjusted under 35 U.S.C. 154(b) by 94 days.

(21) Appl. No.: 09/652,522

(22) Filed: Aug. 31, 2000

(51) Int. Cl.[7] ..... G09F 15/00

(52) U.S. Cl. ..... 40/606; 40/610; 47/39; 47/44; 47/47; D11/121

(58) Field of Search ..... 40/538, 539, 645, 40/606, 610, 611; 248/163.1, 165, 166, 168, 177.1, 915; 47/39, 44, 47; D11/121, 125, 127, 128; D20/30, 31

(56) References Cited

U.S. PATENT DOCUMENTS

| | | | | | |
|---|---|---|---|---|---|
| 2,697,575 | A | * | 12/1954 | Eames | 248/175 |
| 2,850,826 | A | * | 9/1958 | Testa | 47/39 |
| 4,203,242 | A | * | 5/1980 | Griffin | 40/610 |
| 4,941,283 | A | * | 7/1990 | Armstrong | 47/39 |
| 5,162,138 | A | | 11/1992 | Caflisch et al. | 428/17 |
| D332,581 | S | * | 1/1993 | Mankey | D11/121 |
| 5,274,537 | A | * | 12/1993 | Altman | 362/353 |
| 5,567,045 | A | | 10/1996 | Bucek | 362/636 |
| D383,946 | S | * | 9/1997 | Fillipp et al. | D11/121 |
| 5,677,018 | A | | 10/1997 | Shin | 428/18 |
| 5,836,095 | A | | 11/1998 | Crowell | 40/299 |
| 5,876,111 | A | | 3/1999 | Wu | 362/250 |
| 5,878,945 | A | | 3/1999 | Weder | 229/117.01 |
| D412,369 | S | | 7/1999 | Kumar | D26/16 |
| 5,927,676 | A | * | 7/1999 | Lefton | 40/606 |
| 6,000,820 | A | | 12/1999 | Murray | 362/441 |
| 6,027,083 | A | * | 2/2000 | Chang | 47/39 |
| D430,817 | S | * | 9/2000 | Salandra | D11/121 |
| D445,720 | S | * | 7/2001 | Glaubitz | D11/128 |

* cited by examiner

*Primary Examiner*—Lynne H. Browne
*Assistant Examiner*—James M. Hewitt
(74) *Attorney, Agent, or Firm*—Kinney & Lange, P.A.

(57) ABSTRACT

A stand displaying a member of the cucurbitaceae family includes a support for holding the member of the cucurbitaceae family. A figure associated with the support cooperates with the member of the cucurbitaceae family to complete a display.

29 Claims, 3 Drawing Sheets

DISPLAY STAND

BACKGROUND OF THE INVENTION

The present invention relates to a pumpkin stand. In more particular, the present invention relates to a stand to display a member of the cucurbitaceae family and in particular, a pumpkin during the Halloween season.

People enjoy decorating their houses and lawns for holiday seasons and particularly Halloween. Traditionally, people carve pumpkins into jack-o-lanterns land place candles within the jack-o-lanterns thereby illuminating a face carved into the pumpkin. The jack-o-lanterns typically are displayed on the front steps or on the lawn of a residence.

Over time, more innovative lawn displays for Halloween have become popular. For instance, leaf bags are now made of an orange color having a black face printed into the orange background. When a bag is filled with leaves, the bag resembles the shape of a pumpkin and the black face projects an image of a jack-o-lantern.

There are many different innovative Halloween decorations including those disclosed in the Murray U.S. Pat. No. 6,000,820 which discloses low voltage lighted novelty decorations. One of the decorations which can be illuminated is a pumpkin configuration.

The Bucek U.S. Pat. No. 5,567,045 discloses a decorative light fixture covering for outdoor and indoor lights. The decorative light fixtures are designed to enclose existing shaded lights, lampposts and carriage lamps. One decorative light fixture coverings disclosed in the Bucek patent includes a jack-o-lantern figure.

The Shin U.S. Pat. No. 5,677,018 discloses a candy tree with a conical shape having wrapped candies adhesively and non-permanently attached to the candy tree. The candies cover the entire surface of a plastic or styrofoam cone which form the principal part of the tree. Decorative elements include a pumpkin being disposed on the top of the tree.

The Wu U.S. Pat. No. 5,876,111 discloses a decorative lighting string with expandable and shrinkable three-dimensional units. The Wu patent discloses a decorative lighting string having pumpkin figures as the expandable and shrinkable three-dimensional units.

The Kumar Des. U.S. Pat. No. 412,369 discloses a cauldron-shaped votive candle holder. One of the cauldron-shaped votive candle holders disclosed in the Kumar design patent includes a design of a jack-o-lantern.

The Crowell U.S. Pat. No. 5,836,095 discloses a carrying bag. One of the carrying bags disclosed in the Crowell patent includes a bag having a jack-o-lantern design.

The Weder U.S. Pat. No. 5,878,945 discloses a number of self-erecting containers. One of the self-erecting containers disclosed in the Weder patent includes a handle and an outer cover for the container resembling a jack-o-lantern. The basket having the jack-o-lantern cover can be used as a trick or treat basket on Halloween.

BRIEF SUMMARY OF THE INVENTION

The present invention includes a stand for displaying a member of the cucurbitaceae family. The stand includes a support for holding the member of the cucurbitaceae family. A figure associated with the support cooperates with the member of the cucurbitaceae family to complete a display.

DETAILED DESCRIPTION

Figure 1:
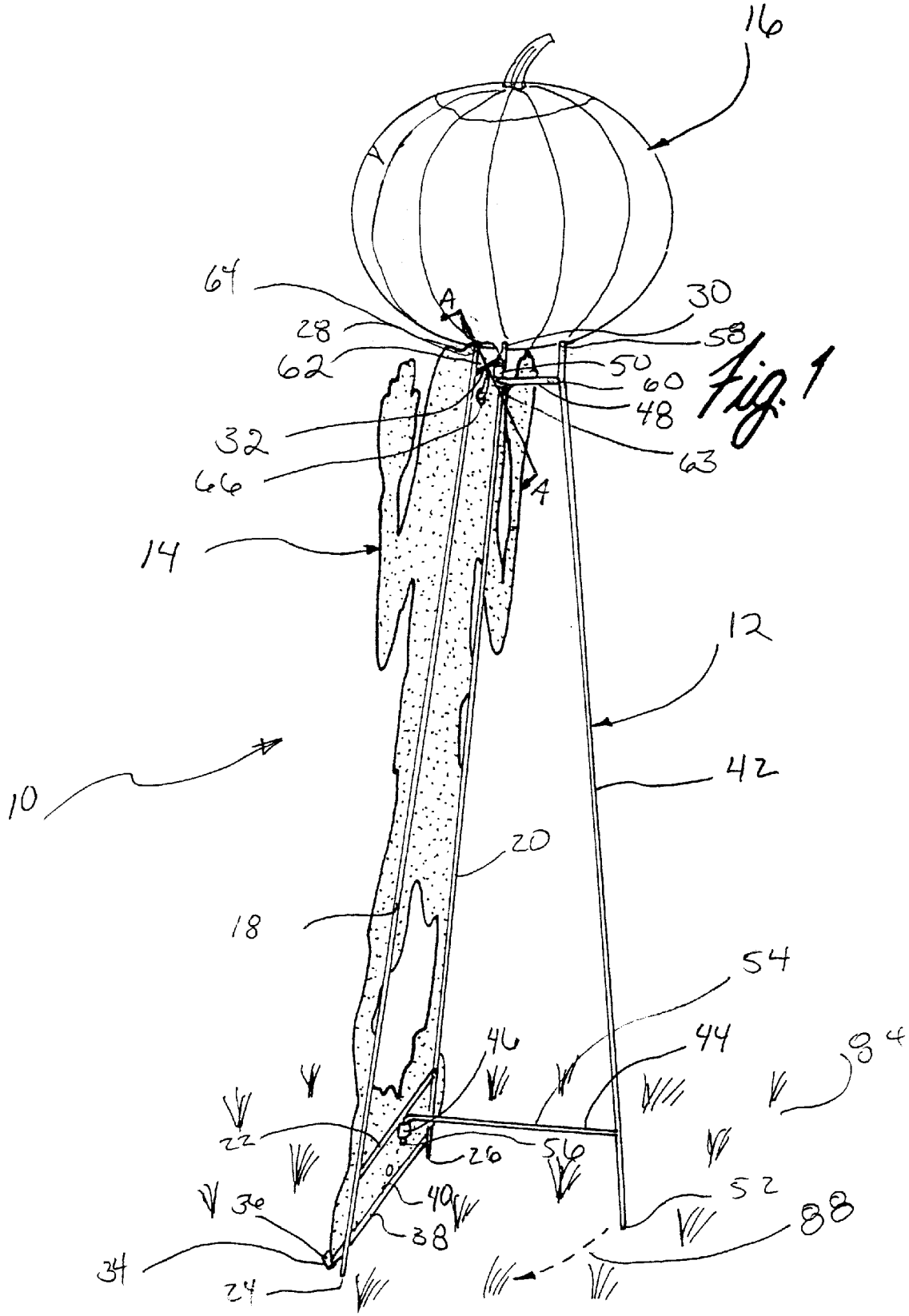
FIG. 1 is a perspective view of the stand of the present invention.

A stand of the present invention is generally illustrated in FIG. 1 at 10. A FIG. 14 is securely positioned onto a support frame 12. A member of the cucurbitaceae family 16 is secured to the support frame 12 such that the member of the cucurbitaceae family 16 cooperates with the FIG. 14 to complete a display. What is meant by the display is a presentation of the member of the cucurbitaceae family 16 cooperating with the FIG. 14.

In this application the FIG. 14 includes a representation of any form. The FIG. 14 can represent any animate, inanimate, fictional, mythical, or spiritual form including a human, an animal, or a mythical creature. The list of the types of FIG. 14 is illustrative of the types of FIG. 14 within the scope of this invention and is not to be limiting the scope of the invention in any way.

In one alternative, the FIG. 14 is incomplete because a feature of the FIG. 14 is missing. The member of the cucurbitaceae family 16 is substituted for the missing feature of the FIG. 14 to create the display. In a second alternative, the member of the cucurbitaceae family 16 may be an accessory to a complete FIG. 14 to create the display.

The cucurbitaceae family, also known as the gourd family, includes the cucurbita genus, which include pumpkins and squashes, but includes other genus such as the cucumis genus, which includes cucumbers. All members of the cucurbitaceae family capable of replacing a missing feature of the FIG. 14 or provide an accessory to the FIG. 14 and thereby create the display are within the scope of this invention.

A pumpkin 16, of the cucurbitaceae family and the cucurbita genus, is the preferred replacement of a feature or accessory to the FIG. 14 and as such will be referred to throughout this application. Although a pumpkin 16 is being referenced, the present invention is not limited only to pumpkins but is inclusive of members of the cucurbitaceae family.

Figure 2:
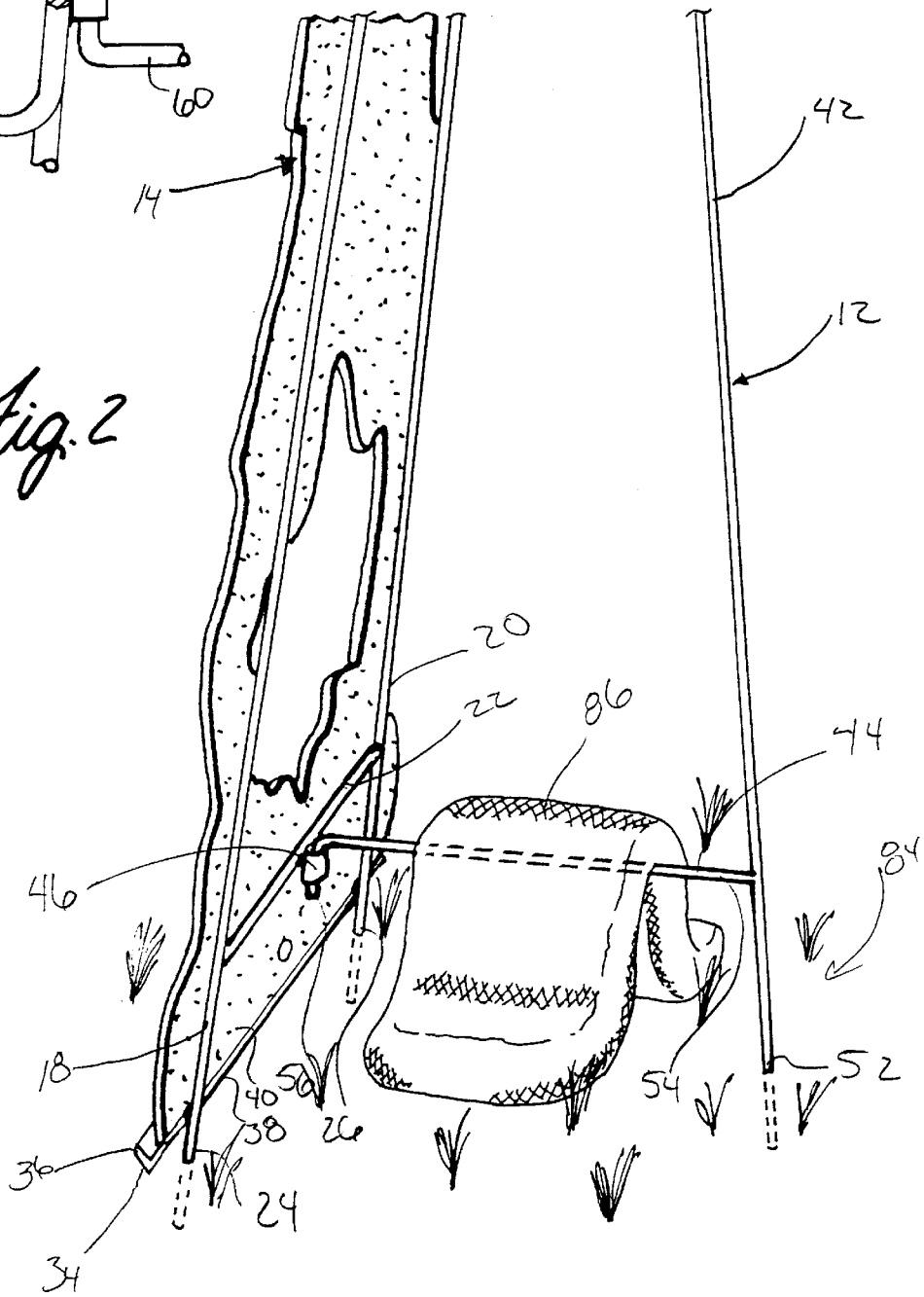
FIG. 2 is a partial perspective view of the stand of the present invention being secured in a selected position.

Referring to FIGS. 1 and 2, the support frame 12 includes a first leg 18 connected to a second leg 20 by a bottom support member 22 proximate a first end 24, 26 of the first and second legs 18, 20, respectively. The first and second legs 18, 20 are also connected proximate second ends 28, 30, respectively, by a top support member 32. The bottom support member 22 is longer than the top support member 32 causing the first ends 24, 26 of the first and second legs 18, 20 to be spaced further apart than the second ends 28, 30 of the first and second legs 18, 20. Spacing the first ends 24, 26 of the first and second legs 18, 20 apart gives the support frame 12 stability because the first ends 24, 26 act as a portion of a base for the support frame 12. Additionally, it is advantageous to space the second ends 28, 30 proximate each other such that the second ends 28, 30 support the pumpkin 16.

An angled member 34 is fixedly attached to a front side of the first and second legs 18, 20 proximate the first ends 24, 26. The angled member 34 is positioned below the bottom support member 22 and creates a channel between a vertical portion 36 of the angled member 34 and the front side of the first and second legs 18, 20. What is meant by the front side is the side of the support frame 12 which contacts and displays the FIG. 14. A flat, bottom surface 40 of the FIG. 14, is positioned adjacent to a horizontal portion 38 of the angled member 34 when the FIG. 14 is supported by the support frame 12.

Figure 3:
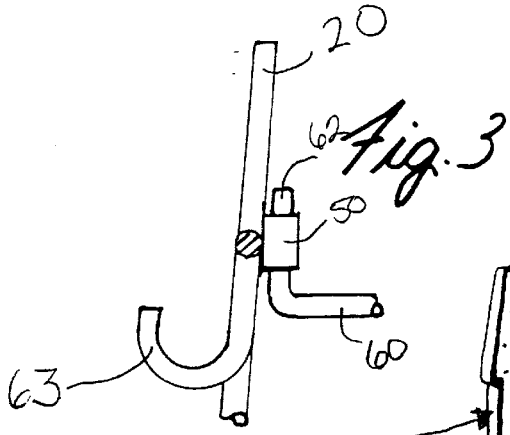
FIG. 3 is a sectional view of the top support member of the present invention as viewed along the section line A—A in FIG. 1.

A third leg 42 is pivotally attached to the first and second legs 18, 20 by the cooperation of a bottom stabilizing member 44 with a surface defining a through bore within a bottom cylindrical portion 46 attached to the bottom support member 22 as best illustrated in FIG. 2. A top stabilizing member 48 is pivotally attached to a top cylindrical portion 50 fixedly attached to the top support member 32 by the cooperation of the top stabilizing member 48 with a surface defining a through bore within the top cylindrical portion 50 as best illustrated in FIG. 3.

The bottom cylindrical portion 46 is fixedly attached to a back side of the bottom support member 22 substantially in the center of the bottom support member 22. The top cylindrical portion 50 is fixedly attached to a back side of the top support member 32 substantially in the center of the top support member 32. What is meant by the back side is the side opposite or 180 degrees away from the front side. Because the first and second legs 18, 20 slant toward each other in a substantially symmetrical fashion, the bottom cylindrical portion 46 and the top cylindrical portion 50 are substantially aligned when centrally positioned on the bottom and top support members 22, 32, respectively.

The bottom stabilizing member 44 is attached to the third leg 42 proximate a first end 52 of the third leg 42. The bottom stabilizing member 44 is generally L-shaped having an end of a shaft 54 attached to the third leg 42 and a shank 56 extending downwardly from the shaft 54. The shank 56 is positioned through the surface defining the through bore in the bottom cylindrical portion 46 thereby creating a first pivotal attachment of the third leg 42 to the first and second legs 18, 20 proximate the first ends 24, 26, 52 of the first, second and third legs 18, 20, 42, respectively.

The top stabilizing member 48 is attached to the third leg 42 proximate a second end 58. The top stabilizing member 48 is generally L-shaped having an end of a shaft 60 attached to the third leg 42. Extending upwardly from the shaft 60 of the top stabilizing member 48 is a shank 62 which cooperates with the surface defining the through bore within the top cylindrical portion 50 thereby creating a second pivotal engagement of the third leg 42 with the first and second legs 18, 20.

One skilled in the art will realize that having the shank 56 extending downwardly from the shaft 54 of the bottom stabilizing member 44 and having the shank 62 extending upwardly from the shaft 60 of the top stabilizing member 48 prevents the third leg 42 from accidentally detaching from the first and second legs 18, 20. To disengage the third leg 42 from the first and second legs 18, 20 a force must be applied to either the bottom or top stabilizing member 44, 48 which disengages either shank 56, 62 from the bottom or top cylindrical portions 46, 50, respectively. One skilled in the art will recognize that the bottom stabilizing member 44 and the top stabilizing member 46 are attached to the third leg 42 in a planar configuration.

A length of the shaft 54 of the bottom stabilizing member 44 is longer than a length of the shaft 60 of the top stabilizing member 48 causing the second end 58 of the third leg 42 to be proximate the second ends 28, 30 of the first and second legs 18, 20 thereby allowing each of the second ends 28, 30, 58 of the first, second and third legs 18, 20, 42, respectively, to engage the pumpkin 16. The first end 52 of the third leg 42 is a distance from the first and second legs 18, 20, thereby creating a more stable base for the support frame 12. Preferably, the first, second and third legs 18, 20, 42 as well as the bottom support member 22, the top support, member 32, the bottom stabilizing member 44 and the top stabilizing member 48 are constructed from a steel material having a circular cross-section.

The bottom support member 22 and top member 32 are preferably welded to the first and second support legs 18, 20 in a planar configuration.

A hook 63 is welded to the front side of the top support member 32 and extends outwardly from the front side. Each member of the support frame 12 is finished with a powder finish which coats and also prevents the support frame 12 from rusting or deteriorating.

The FIG. 14 has a flat profile and contact the front sides of the first and second legs 18, 20. A surface 66 defining an aperture is proximate a top surface 64 of the FIG. 14. The surface 66 defining the aperture cooperates with the hook 63 attached to the top support member 32 thereby securing the FIG. 14 to the support frame 12. A bottom surface 40 of the FIG. 14 is preferably flat and cooperates with the flat portion 38 of the angled member 34. The flat, bottom surface 40 of the FIG. 14 is positioned between the vertical portion 36 of the angled member 34 and the support frame 12 such that the FIG. 14 is retained proximate the support frame 12.

Figure 4:
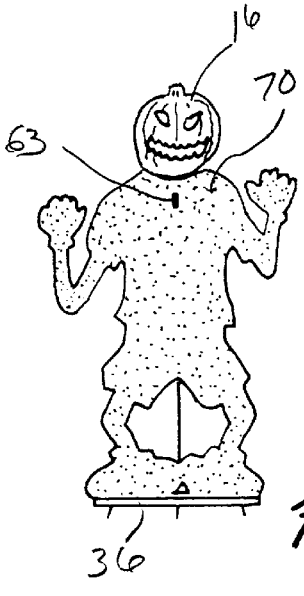
FIG. 4 is a front view of the present invention creating a display in a form of a goblin.
Figure 5:
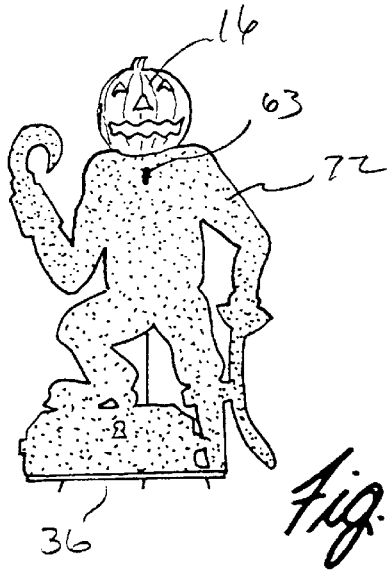
FIG. 5 is a front view of the present invention creating a display in a form of a pirate.
Figure 6:
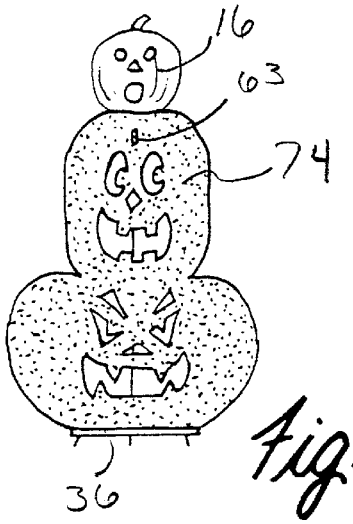
FIG. 6 is a front view of the present invention creating a display in a form of a totem.
Figure 7:
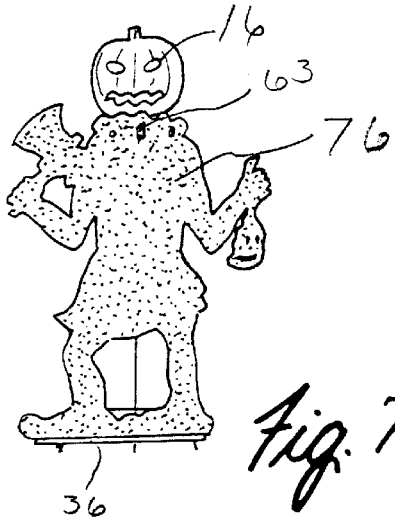
FIG. 7 is a front view of the present invention creating a display in a form of a headhunter.
Figure 8:
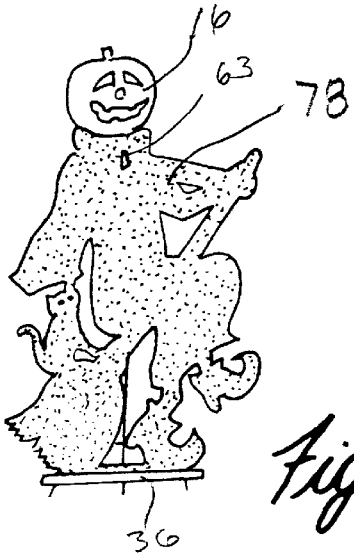
FIG. 8 is a front view of the present invention creating a display in a form of a witch.
Figure 9:
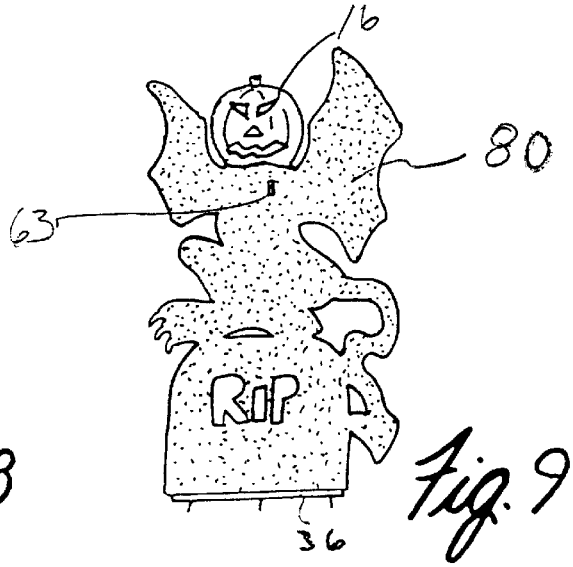
FIG. 9 is a front view of the present invention creating a display in a form of a gargoyle.

The FIG. 14 can be made of many different forms. The FIG. 14 of the present invention includes a goblin 70 with a pumpkin 16 replacing a head of the goblin 70 to complete the display as illustrated in FIG. 4. The FIG. 14 includes a pirate 72 having a pumpkin 16 replacing the head of the pirate 72 to complete the display as illustrated in FIG. 5. The FIG. 14 also includes a totem 74 having a pumpkin 16 for a head to complete the display illustrated in FIG. 6. The FIG. 14 includes a headhunter 76 having a pumpkin 16 for a head to complete the display as illustrated in FIG. 7. The FIG. 14 also includes a witch 78 having a pumpkin 16 for a head to complete the display as illustrated in FIG. 8. The FIG. 14 also includes a gargoyle 80 having a pumpkin 16 for a head to complete the display as illustrated in FIG. 9. FIGS. 4–9 are illustrative of the FIG. 14 and the displays as defined by the present invention but are not to be construed as limiting of the scope of FIG. 14 or displays included in the present invention.

Preferably, the FIG. 14 are constructed of a corrugated, black plastic which provides an aesthetically pleasing configuration while providing a strong resilient material capable of withstanding the wind and the elements. The FIG. 14 are preferably approximately 32 inches in height by 28 inches in width although the width and height can vary provided that the distance from the flat, bottom surface 40 of the FIG. 14 to the surface 66 defining the aperture remains the same and the top surface 64 of the FIG. 14 does not extend beyond the second ends 28, 30, 58 of the first, second and third legs 18, 20, 42, respectively.

To display a pumpkin 16, the pumpkin 16 is preferably carved into a jack-o-lantern having a face. The support frame 12 is placed in a selected location and the third leg 42 is rotated away from the first and second legs 18, 20 such that the top and bottom stabilizing members 48,44 are substantially perpendicular to the top and bottom support members 32, 22, thereby maximizing the base area covered by the first, second and third legs 18, 20, 42. By positioning the top and bottom stabilizing members 48, 44 in a perpendicular position to the top and bottom support members 32, 22, the support frame 12 is substantially in a tripod configuration.

To secure the support frame 12 in the selected location, the first ends 24, 26, 52 of the first, second and third legs 18, 20, 42 are preferably pressed into a surface 84 supporting the support frame as illustrated in FIG. 2. Alternatively, if the first ends 24, 26, 52 of the first, second and third legs 18, 20, 42 cannot be pressed into the surface 84 supporting the support frame 12, a sand bag 86 or any other suitable weight may be placed over the first stabilizing member 44 thereby preventing the support frame 12 from moving as further illustrated in FIG. 2. The pivotal engagement of the third leg 42 with the first and second legs 18, 20 allows the stand to be stored in a minimal amount of space by rotating the third leg 42 towards either the first or second legs 18, 20 as illustrated by arrow 88 illustrated in FIG. 1. Positioning the third leg 42 adjacent to either the first or second leg 18, 20 flattens the support frame 12 making the stand 10 easier to transport or ship.

With the support frame 12 secured in the selected location, a FIG. 14 is secured to the support frame 12 by disposing the surface 66 defining the aperture within the FIG. 14 about the hook 63. The flat, bottom surface 40 of the FIG. 40 is positioned adjacent to the flat portion 38 of the angled member 34 such that the vertical portion 36 of the angled member 34 and the front side of the support frame 12 retain the FIG. 14 proximate the support frame 12. In the preferred embodiment the second ends 28, 30 of the first and second legs 18, 20 lean toward the third leg 42 relative to the first ends 24, 26 of the first and second legs 18,20 thereby allowing gravity to aid in retaining the FIG. 14 proximate the support frame 12.

Once the support frame 14 is secured in the selected positioned, the jack-o-lantern 16 is placed on the second ends 28, 30, 58 of the first, second and third legs 18, 20, 42, respectively. Preferably, the second ends 28, 30, 58 of the first, second and third legs 18,20,42 are pointed which allows the second ends 28, 30, 58 to easily penetrate the pumpkin 16 and thereby secure the pumpkin 16 to the support frame 12. The carved face of the pumpkin 16 is placed in cooperation with the FIG. 14 such that the carved face acts as the face of the FIG. 14 and the pumpkin 16 acts as the head of the FIG. 14 to complete the display as best illustrated in FIGS. 4–9. To aid in the effect of a jack-o-lantern 16 acting as the head of the FIG. 14, an illuminating device such as candle or a battery operated light may be placed within the interior of the jack-o-lantern 16 allowing the face of the jack-o-lantern 16 to be readily seen at night.

Although the present invention has been described with reference to preferred embodiments, workers skilled in the art will recognize that changes may be made in form and detail without departing from the spirit and scope of the invention.

What is claimed is:

1. A display comprising:

a member of the cucurbitaceae family;

a support comprising a tripod having a first leg, second leg and third leg for holding the member of the cucurbitaceae family; and a figure associated with the support, the figure cooperating with the member of the cucurbitaceae family to complete the display.

2. The display of claim 1 wherein the support comprises a support frame including the legs of the tripod wherein the legs have first ends and second ends and wherein the first ends engage a surface which supports the support frame.

3. The display of claim 2 wherein the second ends of the legs are pointed and hold the member of the cucurbitaceae family.

4. The display of claim 1 wherein the tripod collapses by pivoting the third leg proximate either the first leg or the second leg.

5. The display of claim 1 wherein a surface defining an aperture within the figure cooperates with a hook attached to the support to secure the figure to the support.

6. Then display of claim 1 wherein a bottom surface of the figure cooperates with an angled member attached to the support to secure the figure to the support.

7. The display of claim 1 wherein the member of the cucurbitaceae family is a pumpkin.

8. The display of claim 1 wherein the display comprises the member of the cucurbitaceae family completing a presentation of the figure by becoming a missing component of the figure.

9. The display of claim 1 wherein the display comprises the member of the cucurbitaceae family completing a presentation of the figure by becoming an accessory to the figure.

10. A method of displaying a member of the cucurbitaceae family comprising:

positioning a support for holding the member of the cucurbitaceae family in a desired location, the support comprising a tripod having a, a second leg and third leg;

positioning a figure upon the support; and holding a member of the cucurbitaceae family on the support such that the member of the cucurbitaceae family and the figure cooperate to create a display.

11. The method of claims 10 wherein the support comprises a support frame including the legs of the tripod wherein the legs have first ends and second ends and wherein the first ends engage a surface which supports the support frame.

12. The method of claim 11 wherein the second ends of the legs are pointed and hold the member of the cucurbitaceae family.

13. The method of claim 10 wherein the tripod-collapses by pivoting the third leg proximate either the first leg or the second leg.

14. The method of claim 10 wherein a surface defining an aperture within the figure cooperates with a hook attached to the support to secure the figure to the support.

15. The method of claim 10 wherein a bottom surface of the figure cooperates with an angled member attached to the support to secure the figure to the support.

16. The method of claim 10 wherein the member of the cucurbitaceae family is a pumpkin.

17. The method of claim 10 wherein the display comprises the member of the cucurbitaceae family completing a presentation of the figure by becoming a missing component of the figure.

18. The method of claim 10 wherein the display comprises the member of the cucurbitaceae family completing a presentation of the figure by becoming an accessory to the figure.

19. A display comprising:

a member of the cucurbitaceae family;

a support for holding the member of the cucurbitaceae family and having a hook; and a figure associated with the support and having a surface with an aperture cooperating with the hook to secure the figure to the support, the figure cooperating with the member of the cucurbitaceae family to complete the display.

20. The display of claim 19 wherein the support comprises a support frame including a plurality of legs having first ends and second ends wherein the first ends engage a surface which supports the support frame.

21. The, display of claim 20 wherein the second ends of the plurality of legs are pointed and hold the member of the cucurbitaceae family.

22. The display of claim 19 wherein the support frame comprises a tripod.

23. The display of claim 19 wherein the display comprises the member of the cucurbitaceae family completing a presentation of the figure by becoming a missing component of the figure.

24. The display of claim 19 wherein the display comprises the member of the cucurbitaceae family completing a presentation of the figure by becoming an accessory to the figure.

25. A method of displaying a member of the cucurbitaceae family comprising:

positioning a support for holding the member of the cucucbitaceae family in a desired location, the support having a hook;

positioning a figure upon the support with the hook extending through an aperture on the figure; and holding a member of the cucurbitaceae family on the support such that the member of the cucurbitaceae family and the figure cooperate to create a display.

26. The method of claim 25 wherein the support comprises a support frame including a plurality of legs having first ends and second ends wherein the first ends engage a surface which supports the support frame.

27. The method of claim 26 wherein the support frame comprises a tripod.

28. The method of claim 25 wherein the display comprises the member of the cucurbitaceae family completing a presentation of the figure by becoming a missing component of the figure.

29. The method of claim 25 wherein the display comprises the member of the cucurbitaceae family completing a presentation of the figure by becoming an accessory to the figure.

* * * * *

UNITED STATES PATENT AND TRADEMARK OFFICE

CERTIFICATE OF CORRECTION

PATENT NO. : 6,546,654 B1
DATED : April 15, 2003
INVENTOR(S) : David L. Henson

It is certified that error appears in the above-identified patent and that said Letters Patent is hereby corrected as shown below:

Title page,
Item [57], ABSTRACT,
Line 1, insert -- for --, after "stand"

Column 6,
Line 14, after second occurrence of "the", insert -- plurality of --
Line 23, delete "Then", insert -- The --
Line 52, after second occurrence of "ends of the", insert -- plurality of --

Column 7,
Line 18, delete "The,", insert -- The --

Signed and Sealed this

Twenty-third Day of September, 2003

JAMES E. ROGAN
*Director of the United States Patent and Trademark Office*